US007805787B2

(12) United States Patent
Wallis

(10) Patent No.: US 7,805,787 B2
(45) Date of Patent: Oct. 5, 2010

(54) CUSHION WITH SCENT CARTRIDGE

(76) Inventor: Matthew C. Wallis, 110 Highland Church Rd., Paducah, KY (US) 42001

( * ) Notice: Subject to any disclaimer, the term of this patent is extended or adjusted under 35 U.S.C. 154(b) by 463 days.

(21) Appl. No.: 11/577,624

(22) PCT Filed: Oct. 22, 2004

(86) PCT No.: PCT/US2004/034823

§ 371 (c)(1),
(2), (4) Date: Apr. 29, 2008

(87) PCT Pub. No.: WO2006/046940

PCT Pub. Date: May 4, 2006

(65) Prior Publication Data

US 2008/0256711 A1 Oct. 23, 2008

(51) Int. Cl.
*A47C 20/00* (2006.01)

(52) U.S. Cl. ..... 5/641; 5/636; 5/639

(58) Field of Classification Search ..... 5/641, 5/636, 652; 297/397, 423.41, 423.46, 463.1, 297/463.2

See application file for complete search history.

(56) References Cited

U.S. PATENT DOCUMENTS

| | | | | |
|---|---|---|---|---|
| 367,953 | A * | 8/1887 | Bowman | 5/641 X |
| 4,219,145 | A | 8/1980 | Jaeschke et al. | |
| 4,258,874 | A | 3/1981 | Webinger et al. | |
| 4,402,433 | A | 9/1983 | Webinger | |
| 4,783,866 | A | 11/1988 | Simmons et al. | |
| 4,821,355 | A | 4/1989 | Burkhardt | |
| 5,038,431 | A | 8/1991 | Burgin et al. | |
| 5,201,568 | A | 4/1993 | Christensen, Jr. | |
| 5,220,636 | A | 6/1993 | Chang | |
| 5,299,335 | A | 4/1994 | Ivester et al. | |
| 5,918,333 | A | 7/1999 | Takashima | |
| 6,039,266 | A | 3/2000 | Santini | |
| 6,109,537 | A | 8/2000 | Heath | |
| 6,430,764 | B1 | 8/2002 | Peters | |
| 6,647,572 | B2 | 11/2003 | Lee | |
| 6,694,550 | B2 | 2/2004 | Lee | |
| 6,763,538 | B1 | 7/2004 | Tsai | |

* cited by examiner

*Primary Examiner*—Anthony D Barfield
(74) *Attorney, Agent, or Firm*—King & Schickli, PLLC

(57) ABSTRACT

A cushion device comprising a body having an outer surface defining a boundary and at least one cartridge positioned outside the boundary. The cartridge may include a scented substance and a cover for varying the exposure of it to the surroundings.

7 Claims, 4 Drawing Sheets

CUSHION WITH SCENT CARTRIDGE

TECHNICAL FIELD

The present invention relates generally to a cushion and, more specifically, to a cushion having at least one scent cartridge positioned externally thereon.

BACKGROUND OF THE INVENTION

Many different configurations of cushions or pillows exist in today's society. Some cushions are used to pad furniture, while others provide comfort to a person lying in a reclined position. Many types of materials have been used to form these cushions. Some of these cushions have incorporated materials or inserts comprising a pleasant aroma. The aroma often provides a therapeutic benefit to the person using the cushion. For instance, certain scents can clear breathing passageways, while others help an individual relax.

Unfortunately, many of the aroma emitting cushions do not have a mechanism for controlling the amount of scent released. Moreover, most of these cushions have the aromatic material positioned within the cushion. This configuration makes it extremely difficult for a user to change the scent or to remove the aromatic material. Additionally, when the aromatic material is positioned within the cushion, the non-scented cushion material often assumes the scent of the aromatic material, thus creating an undesirable condition when a user desires to change or remove the scent.

Accordingly, there is a need in the art for a cushion having an aromatic material supply positioned outside of the boundaries of the cushion. Furthermore, the need exists for a cushion that has a mechanism enabling the user to control the concentration of the scent.

SUMMARY OF THE INVENTION

In accordance with the purposes of the present invention as described herein, a new and improved cushion device is described. The cushion includes a body having an outer surface defining a boundary and at least one cartridge removably attached to the body and positioned outside the boundary.

In one embodiment, the cushion includes a body having at least one aperture passing substantially through the body. A first and second cartridge removably attach to a connector engaging the aperture. The cartridges may include a retainer forming a partially enclosed cavity containing a scented material, and a cover. Additionally, the cushion may include a first and second base that attach to the ends of the connector, while the cartridges attach to the first and second base. The cartridges may also include at least one projection adapted to fit at least one cooperating groove formed in the first and second base.

The invention may further comprise a kit including at least one cartridge adapted for receiving and holding a scented material, wherein the cartridge includes a retainer forming a partially enclosed cavity having at least one opening and a cover. The retainer may include at least one projection adapted to fit at least one cooperating groove formed in a base. The kit may also include at least one connector and a cushion having an aperture for slidably receiving the connector. Additionally, the kit may contain a first base and a second base for receiving a first and second cartridge adapted for receiving and holding the scented material.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE INVENTION

Figure 1:
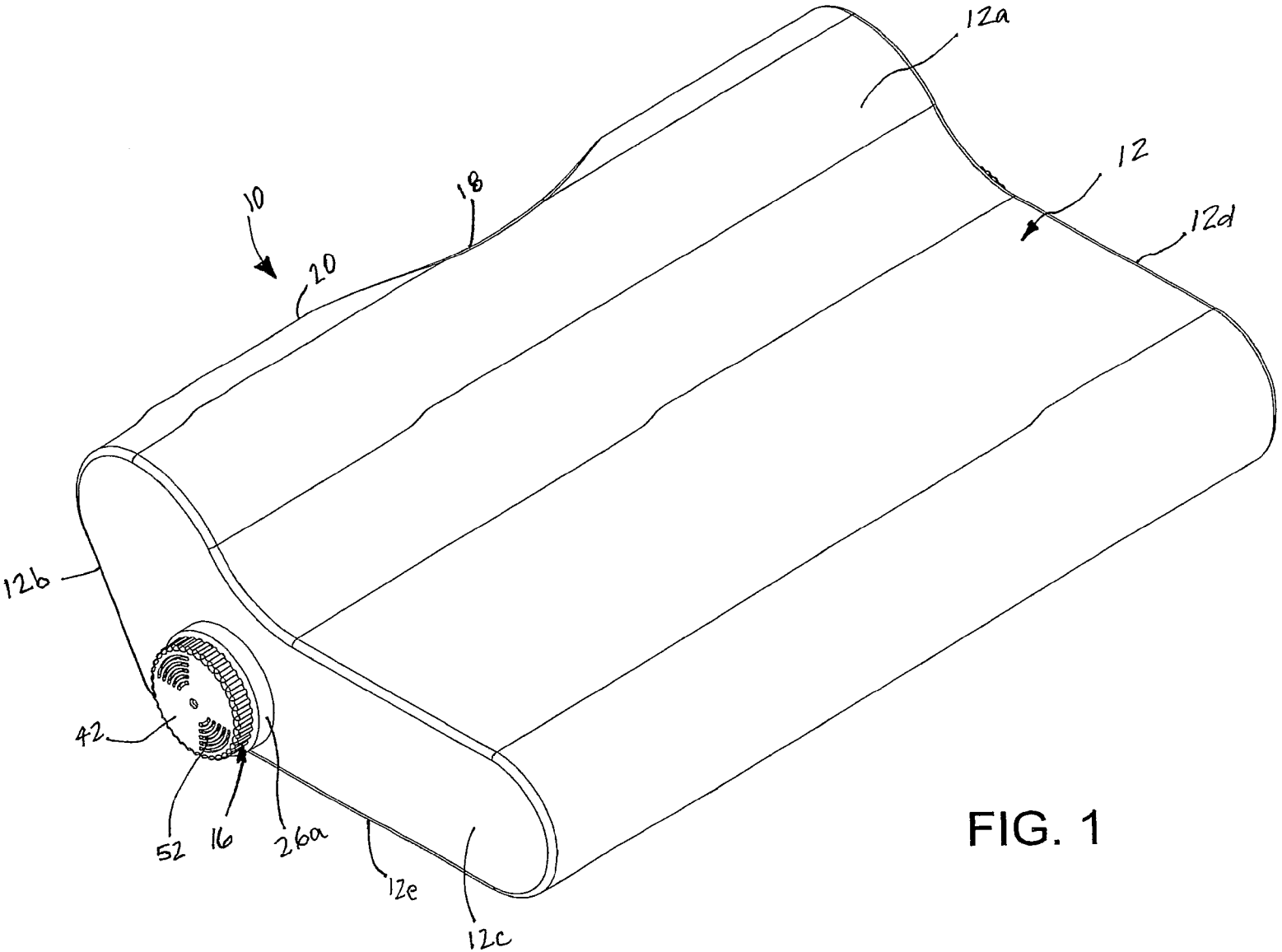
FIG. 1 is a perspective view of the cushion device forming one possible embodiment of the present invention.
Figure 2:
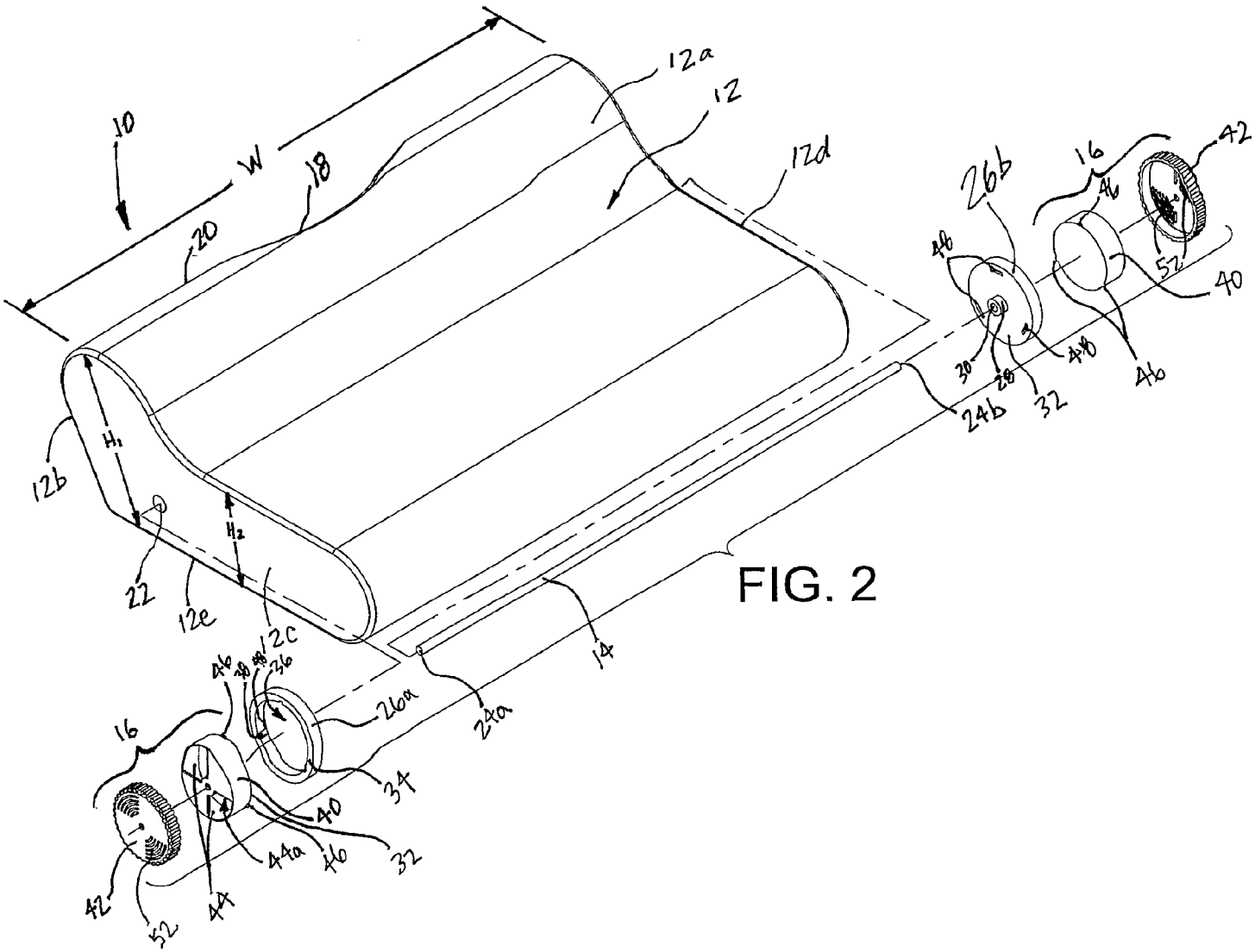
FIG. 2 is an exploded perspective view of the cushion of FIG. 1.

Reference is now made to FIGS. 1 and 2 illustrating one embodiment of the cushion 10 of the present invention. As illustrated, the cushion 10 includes a body 12, a connector 14, and at least one cartridge 16.

In the illustrated embodiment, the body 12 has a curved top surface 12*a*, an inclined rear surface 12*b*, substantially planar side surfaces 12*c*, 12*d*, and a substantially planar bottom surface 12*e*, the totality of which defines a boundary. As shown in FIG. 2, the body has a width W, a first height $H_1$, and a second height $H_2$. The body 12 includes a cutout 18 at a juncture 20 of the top surface 12*a* and the rear surface 12*b*. In this arrangement, the curved top surface 12*a* supports the back and shoulders of a user, while the cutout 18 receives and supports the neck and head of the user. The inclined rear surface 12*b* promotes the positioning of a user's head and neck at a desired location for comfort when lying in a prone or supine position. The cutout 18 also enables a user to position his or her neck in an extended manner to facilitate stretching, therapeutic massage, or other physical therapy. Varying the angle of the inclined rear surface 12*b* and the shape and size of the cutout 18 allows varying degrees of neck stretching and support.

Figure 3:
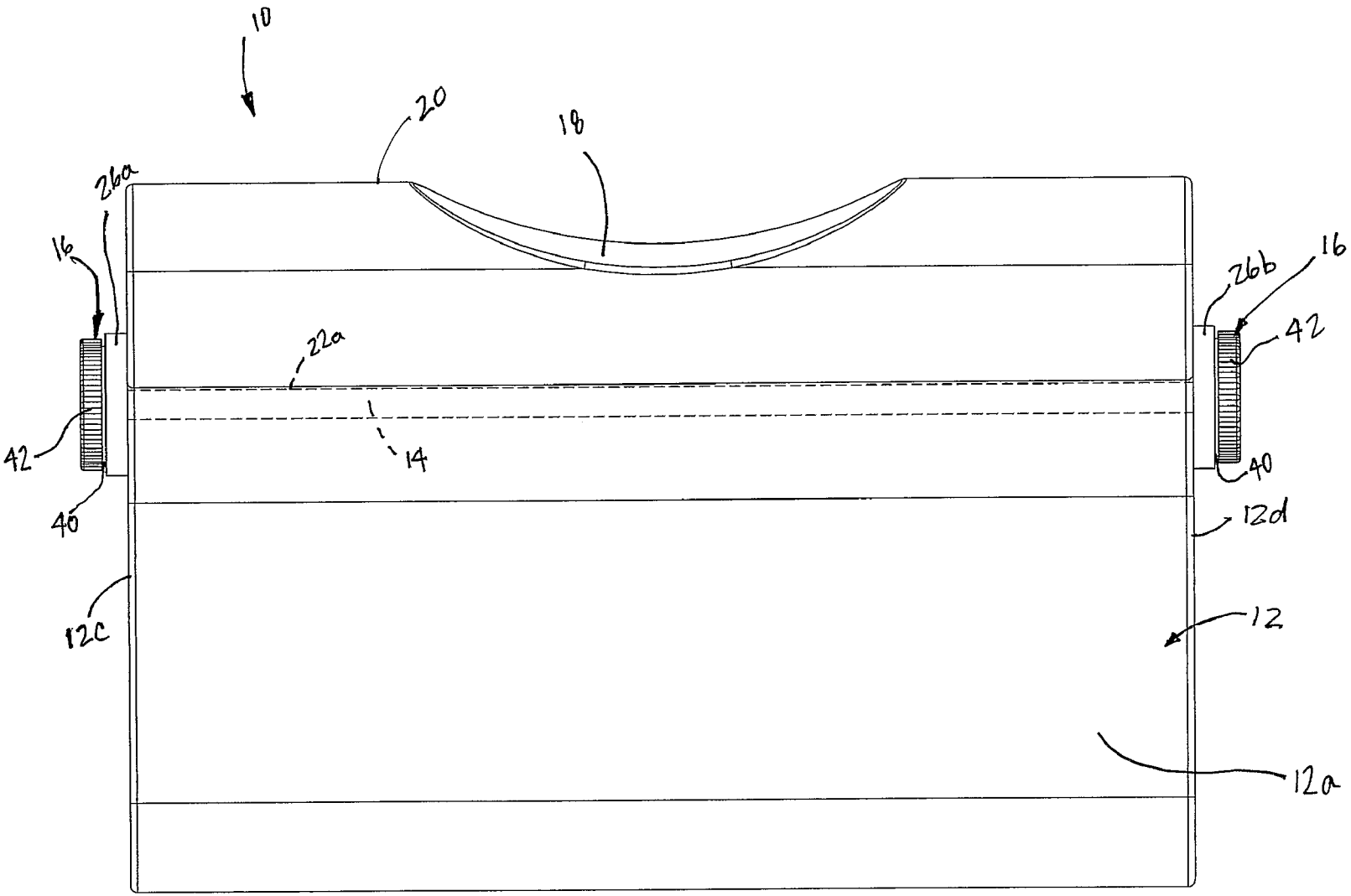
FIG. 3 is a top view of the cushion of FIG. 1.
Figure 4:
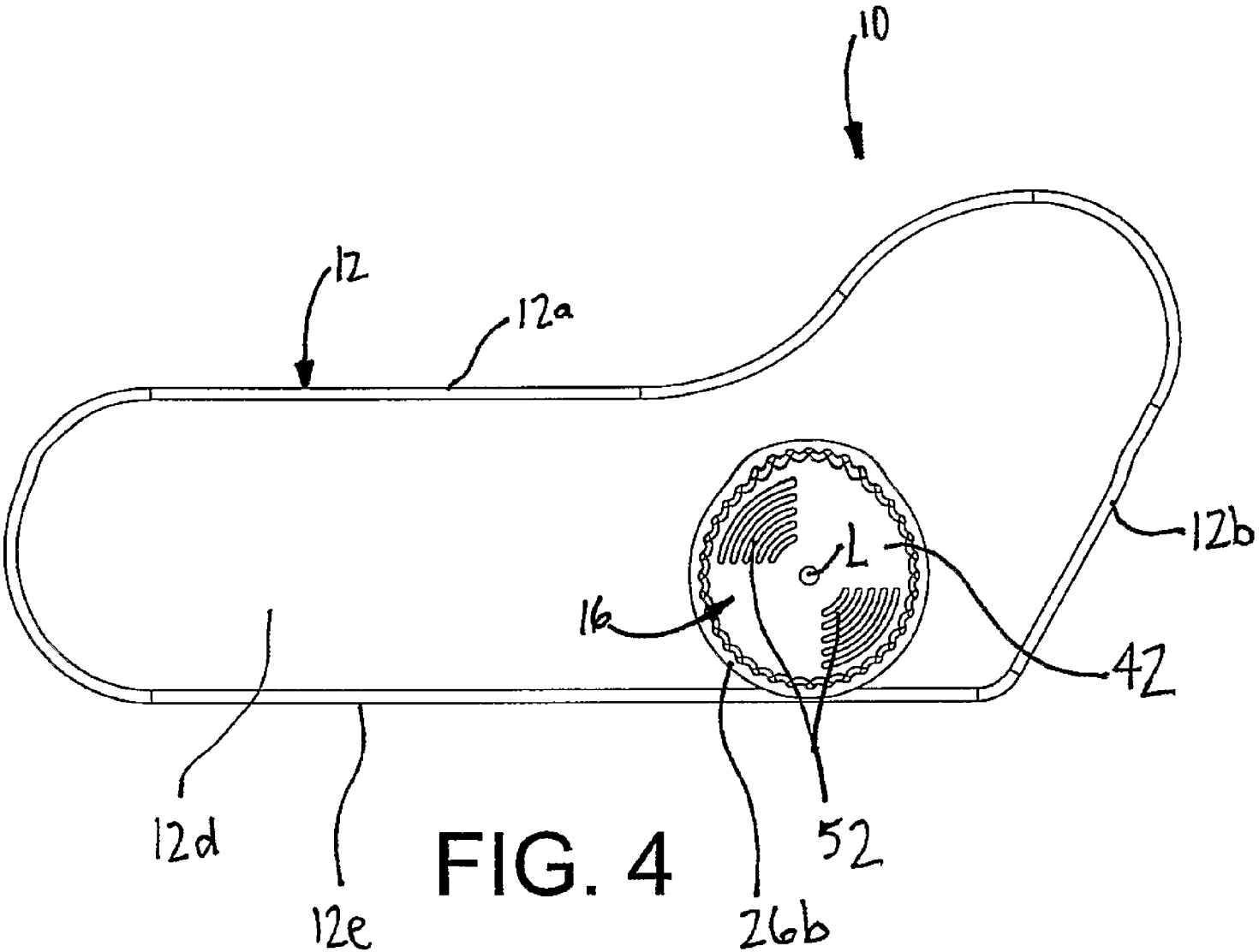
FIG. 4 is a side view of the cushion of FIG. 1.

As shown in FIGS. 1 and 3, the body 12 also includes an aperture 22 passing through a portion of the body 12. In the illustrated embodiment, the aperture 22 consists of a substantially cylindrical channel 22*a* passing through the width W of the body 12. With reference to FIGS. 2 and 3, the connector 14 may be slidably received in channel 22*a*. In one embodiment, the connector 14 consists of a substantially cylindrical rod having a first end 24*a* and a second end 24*b*. The channel 22*a* may be positioned anywhere on the body 12 of the cushion 10, but is typically positioned at a height less than $H_2$. This positioning enables the connector 14 to be placed within the body 12 without substantial detection by a user of the cushion 10. It will be appreciated that the aperture 22 and the channel 22*a* may be any suitable size or shape in accordance with the configuration of the connector 14.

After insertion of the connector 14 through the channel 22*a*, a first base 26*a* attaches to the first end 24*a* of the connector 14, while an identical second base 26*b* attaches to the second end 24*b*, thereby preventing inadvertent removal of the connector 14. In one embodiment, the first and second base 26*a*, 26*b* each consist of a substantially cylindrical disk having a receiver 28 with a base aperture 30 projecting from a bottom surface 32 thereof. The base aperture 30 may have a dimension slightly larger than the dimension of the connector 14, such that the receiver 28 removably receives a portion of the first or second end 24*a*, 24*b* of the connector 14. The first and second base 26*a*, 26*b* may removably attach to the connector 14 via a friction fit, or they may be semi-permanently attached to ends 24*a*, 24*b* of the connector 14 by use of an adhesive, by welding, or by any suitable means of securement.

As shown in FIGS. 1-3, the receiver 28 engages a portion of the cushion aperture 22 of the body 12. In this arrangement, the bottom surface 32 of each base 26*a*, 26*b* contacts either side 12*c*, 12*d* of the body 12. The base 26*a*, 26*b* also includes a circumferential wall 34 defining a recess 36. The wall 34 may include at least one keyway or groove 38 adapted to receive a portion of the cartridges 16.

The cartridges 16 include a retainer 40 and a cover 42. The retainer 40 may comprise a cylinder forming a partially enclosed cavity 44*a* having at least one opening 44. In one embodiment, the opening 44 is substantially wedge-shaped, however, the opening 44 may be any desired shape or size. The retainer 40 also includes at least one projection 46 adapted to fit in the keyway or groove 38 of the base 26*a*, 26*b*. The groove 38 may include a transverse slot 48 positioned at the bottom of the groove 38, in substantially the same plane as the bottom surface 32 of the base 26*a*, 26*b*. Thus, a user wishing to attach the retainer 40 to the base inserts the projection 46 into the groove 38 of the base until the projection 46 engages the slot 48. At this point, the user may rotate or otherwise insert the projection 46 into the slot, thereby completing the attachment process. To remove the retainer 40, the user simply reverses these steps to disengage the projection 46 from the slot 48 and the groove 38. However, a skilled artisan will appreciate that the retainer 40 may removably attach to the base in any desired manner, such as via friction fit. Additionally, the retainer 40 may attach directly to the connector 14, thereby obviating the need for the base 26*a*, 26*b*.

The cavity 44*a* of the retainer 40 may receive a scented substance, such as loose pellets or lumps of scented material, or a container having a scented oil, gel, or other material known in the aroma therapy arts. The cover 42 movably attaches to the retainer 40, so that a user may adjust the concentration of scent. In the illustrated embodiment, the cover 42 has a dimension slightly larger than the dimension of the retainer 40, such that the cover 42 rotates about its longitudinal axis L. The cover 42 may include a plurality of apertures 52 configured substantially identically to the shape of the opening 44 of the cavity 44*a*. In this configuration, rotation of the cover 42 enables a user to vary the exposure of the scented material to its surroundings. For instance, if a user wishes to increase the concentration of the scent, apertures 52 of the cover 42 may be aligned directly over the opening 44 of the retainer 40. Alternatively, to decrease the concentration of the scent, only a portion of the apertures 52 may be aligned over the opening 44, while positioning the remainder of the apertures 52 over the retainer 40. If the user desires only a minimal amount of scent, the apertures 52 may be positioned completely over the retainer 40, such that no portion of the apertures 52 is positioned over the opening 44. Finally, if the user desires no scent, he may completely remove the cartridges from the base 26*a*, 26*b* and the cushion 10. Additionally, if a user wishes to change or replenish the scented material, he may either remove and replace the cartridge 16, or simply remove the cover 42 to insert additional or different scented material into the cavity 44*a* of the retainer 40. The cushion 10 may be fabricated from well-known types of materials. In one embodiment, the body 12 comprises a compressible, resilient material, such as polyurethane or polyether foam. Use of this type of material allows insertion of the connector 14 through the channel 22*a* without the detection of the connector 14 by a user when positioned on the cushion 10. The connector 14, cartridges 16, and base 26*a*, 26*b* may also be fabricated from any material, but would preferably be a polymer such as high-density polyethylene or polypropylene.

It is also contemplated that the cartridges 16 forming one aspect of the present invention may be sold as a kit. The cartridge 16 may include different scented materials and may be packaged together with the connector 14 and base 26*a*, 26*b*, thereby allowing a user to retrofit a body 12, such as a conventional cushion or pillow, previously acquired without cartridges or scented materials.

The foregoing descriptions of various embodiments of the invention are provided for purposes of illustration, and are not intended to be exhaustive or limiting. Modifications or variations are also possible in light of the above teachings. The cushion 10, body 12, cartridges 16, cutout 18, retainer 40, cover 42, base 26*a*, 26*b* and connector 14 may be any desired size, shape, or design. The cartridges 16 could be provided as a one-piece replaceable unit, thus eliminating the need for the cover and retainer. Additionally, the cartridges may comprise any desired combination of scented material, or scented material retainer. Moreover, the cartridges 16 may have any suitable mode or mechanism for adjustment of the concentration of scent. The cartridges 16 may be manufactured, used and sold with or without the cushion 10, connector 14, base 26*a*, 26*b*, or any combination thereof. The scented material may take the form of any medium capable of emitting the desired scent. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A cushion device, comprising:

a body having an outer surface defining a boundary and at least one aperture passing substantially through the body;

a connector engaging the at least one aperture; and a first cartridge and second cartridge, wherein the first cartridge removably attaches to a first end of the connector and the second cartridge removably attaches to a second end of the connector such that the first and second cartridges are positioned external of the boundary further wherein the first and second cartridges comprise: a retainer forming a partially enclosed cavity which receives a scented material; and a cover movably attached to the retainer.

2. The device of claim 1, wherein a first base is attached to the first end of the connector and a second base is attached to a second end of the connector, and the first cartridge is removably attached to the first base and the second cartridge is removably attached to the second base.

3. The device of claim 2, wherein the first and second cartridges include at least one projection adapted to be received by at least one cooperating groove included in the first and second base.

4. The device of claim 3, wherein the at least one cooperating groove is formed in a circumferential wall of the first and second base which defines a recess for receiving a portion of the first and second cartridge.

5. The device of claim 1, wherein the body comprises a pillow having at least one cutout at a juncture of the top surface with a junction of the rear surface of the pillow.

6. The device of claim 5, wherein the side surfaces of the pillow are substantially planar and the top surface of the pillow is curved.

7. The device of claim 6, wherein the side surfaces of the pillow have a first height and a second height, such that the connector is positioned at a height less than the second height.

* * * * *